US010066278B2

(12) United States Patent
Putatunda

(10) Patent No.: US 10,066,278 B2
(45) Date of Patent: Sep. 4, 2018

(54) DEVELOPMENT OF NANOSTRUCTURE AUSTEMPERED DUCTILE IRON WITH DUAL PHASE MICROSTRUCTURE

(71) Applicant: WAYNE STATE UNIVERSITY, Detroit, MI (US)

(72) Inventor: Susil K. Putatunda, Bloomfield Hills, MI (US)

(73) Assignee: Wayne State University, Detroit, MI (US)

( * ) Notice: Subject to any disclaimer, the term of this patent is extended or adjusted under 35 U.S.C. 154(b) by 404 days.

(21) Appl. No.: 14/776,861

(22) PCT Filed: Mar. 17, 2014

(86) PCT No.: PCT/US2014/030187

§ 371 (c)(1),
(2) Date: Sep. 15, 2015

(87) PCT Pub. No.: WO2014/145421

PCT Pub. Date: Sep. 18, 2014

(65) Prior Publication Data

US 2016/0032430 A1 Feb. 4, 2016

Related U.S. Application Data

(60) Provisional application No. 61/788,699, filed on Mar. 15, 2013.

(51) Int. Cl.
*C21D 5/00* (2006.01)
*C22C 37/10* (2006.01)
(Continued)

(52) U.S. Cl.
CPC ..... *C22C 37/10* (2013.01); *C21D 1/00* (2013.01); *C21D 1/19* (2013.01); *C21D 1/20* (2013.01);
(Continued)

(58) Field of Classification Search
CPC ..... C21D 5/00
See application file for complete search history.

(56) References Cited

U.S. PATENT DOCUMENTS

2012/0152413 A1 6/2012 Parolini et al.

FOREIGN PATENT DOCUMENTS

JP 05112817 A 5/1993
JP 2012-126998 A 7/2012
(Continued)

OTHER PUBLICATIONS

International Search Report dated Sep. 1, 2014 from PCT/US2014/030187 filed Mar. 17, 2014, 3 pgs.

*Primary Examiner* — Jessee Roe
(74) *Attorney, Agent, or Firm* — Brooks Kushman P.C.

(57) ABSTRACT

A method for forming an austempered iron composition with a nanoscale microstructure includes a step of heating an iron-carbon-silicon alloy with silicon to a first temperature that is lower than A1 for the iron-carbon-silicon alloy. The iron-carbon-silicon alloy is then adiabatically deformed such that the temperature of the iron-carbon-silicon alloy rises to a second temperature which is sufficient to form proeutectoid ferrite and austenite. The iron-carbon-silicon alloy is cooled to a first austempering temperature. The iron-carbon-silicon alloy is then heated to a second austempering temperature that is greater than the first austempering temperature to form a dual phase microstructure. Characteristically, the dual phase microstructure includes proeutectoid ferrite and ausferrite.

18 Claims, 7 Drawing Sheets

Figure 1:
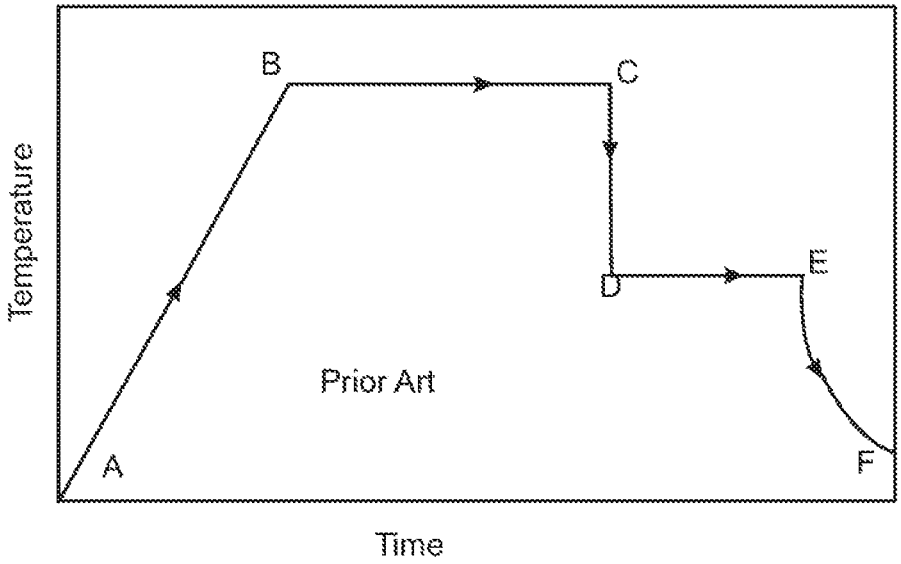

(51) Int. Cl.

| | |
|---|---|
| ***C22C 33/08*** | (2006.01) |
| ***C21D 1/19*** | (2006.01) |
| ***C21D 1/20*** | (2006.01) |
| ***C21D 1/00*** | (2006.01) |

(52) U.S. Cl.
CPC ..... *C21D 5/00* (2013.01); *C22C 33/08* (2013.01); *C21D 2201/03* (2013.01); *C21D 2211/002* (2013.01)

(56) References Cited

FOREIGN PATENT DOCUMENTS

| | | | |
|---|---|---|---|
| KR | 10-2001-0056345 | A | 7/2001 |
| KR | 10-0340468 | B1 | 6/2002 |
| KR | 10-0766770 | B1 | 10/2007 |

DEVELOPMENT OF NANOSTRUCTURE AUSTEMPERED DUCTILE IRON WITH DUAL PHASE MICROSTRUCTURE

CROSS-REFERENCE TO RELATED APPLICATIONS

This application is the U.S. national phase of PCT Application No. PCT/US2014/030187 filed Mar. 17, 2014, which claims the benefit of U.S. Ser. No. 61/788,699 Mar. 15, 2013, the disclosures of which are incorporated in their entirety by reference herein.

TECHNICAL FIELD

In at least one aspect, the present application is related to ductile iron, and in particular to ductile iron with dual phase microstructure.

BACKGROUND

Nano-structured materials have emerged as very important engineering materials in recent years. They are made of crystals with sizes below 100 nm. In these materials 50% of the actual volume consists of grain boundaries. Because of these large numbers of crystalline interfaces an important fraction of the materials have a disordered microstructure with no short-range order. As a result, the nano structured materials exhibit physical and chemical properties different from those usually found in coarse grain crystalline materials. While a significant number of nano-structured materials have been developed in recent years, the application of nano technology in bulk structural materials like steel and cast iron has been rather limited.

The term austempered ductile iron (ADI) describes a family of materials whose properties can be varied over a wide range by the correct choice of heat treatment variables and chemical composition. ADI is an alloyed and heat-treated ductile (or nodular) cast iron. ADI has become a major engineering material due to its excellent properties; these include high strength with good ductility, high wear resistance, good fatigue strength, and fracture toughness. These properties are a result of the development of a unique acicular matrix structure that consists of high carbon austenite ($\gamma_{HC}$) and ferrite ($\alpha$) with graphite nodules dispersed in it. Compared to conventional ductile iron, ADI has nickel, copper and molybdenum added to increase its heat treatability; i.e. to delay the austenite decomposition to pearlite and ferrite upon cooling. Proper austempering heat treatment avoids the formation of unwanted microstructural constituents (such as martensite, carbide and pearlite). ADI has low production costs due to its good castability, excellent machinability and shorter heat treatment processing cycles. Because of these properties, it has been used in a wide variety of applications, including gears, crankshafts, locomotive wheels, connecting rods, and brake shoes etc.

The development of ADI involves two major processing steps. The first step is the melting and casting of ductile cast iron that has been specifically alloyed with elements such as Ni, Cu, and Mo. The second processing step is the heat treatment. The casting is heated to, and held at, temperatures ranging between 815-927•° C. (1500-1700•° F.) for one to two hours. This allows the microstructure to become fully austenitic ($\gamma$). After austenitizing, the alloy is quenched in a molten salt bath to an austempering temperature ranging between 260-400•° C. (500-750•° F.). The casting is kept at temperature for two to four hours; following this, it is air cooled to room temperature. FIG. 1 provides a schematic of a prior art process for forming ADI. As indicated by the line from A to B (A-B), an ductile cast iron is heated to a temperature at which conversion to austenite occurs. The ductile cast iron is held at this temperature for several hours as indicated by B-C. The ductile cast iron is then quenched to an austempering temperature as indicated by C-D and held at this temperature for two hours (D-E). The alloy is then cooled to room temperature as indicated by D-E.

During austempering, ADI goes through a two-stage phase transformation process. In the first stage, the austenite ($\gamma$) decomposes into ferrite ($\alpha$) and high carbon austenite ($\gamma_{HC}$):

$$\gamma^{\bullet} \rightarrow \alpha + \gamma_{HC} \quad \text{(Eq. 1).}$$

If the casting is held at the austempering temperature for too long, a second (and undesirable) reaction occurs. In this reaction, the high carbon austenite can further decompose into ferrite and carbide:

$$\gamma_{HC}^{\bullet} \rightarrow \alpha + \varepsilon \quad \text{(Eq. 2).}$$

In this case, the $\varepsilon$ carbide will make the material brittle; therefore, this reaction must be avoided. In general, the optimum combination of tensile strength and ductility is obtained in ADI after the completion of the first reaction but before the onset of the second reaction. The time period between the completion of the first reaction and the onset of the second reaction is called the "process window". The process window can be enlarged by addition of alloying elements such as Ni, Mo, and Cu.

Proper austempering produces a unique microstructure that consists of high carbon (or transformed) austenite ($\gamma_{HC}$) and acicular ferrite with graphite nodules dispersed in it. The $\gamma_{HC}$ is present in the form of small "slivers" located between the ferrite needles. The exact morphology of the ferrite phase and the relative amounts of ferrite and $\gamma_{HC}$ can be controlled by austempering temperature and time.

During the austempering of ductile cast iron, acicular ferrite grows from austenite by the nucleation and growth process. As the ferrite grows, the remaining austenite becomes enriched with carbon. The form that this ferrite takes is dependent upon the austempering temperature. When the austempering temperature is in the lower bainitic temperature range i.e, between 232-316•° C. (450-600•° F.), a microstructure consisting of bainitic ferrite ($\alpha_B$), austenite ($\gamma_{HC}$), and graphite nodules is developed; the bainitic ferrite in this case consists of needle-shaped particles of aggregated ferrite and precipitation of carbide within.

When the ADI is austempered in the upper bainitic temperature range (above 316•° C. (600•° F.)), an acicular structure of carbide-free ferrite ($\alpha_{CF}$) with a considerable amount of stabilized austenite ($\gamma_{HC}$) develops. This microstructure is referred to as an Ausferritic ($\alpha_{CF}+\gamma_{HC}$) microstructure. It contains an interlocking aggregate of fine, randomly oriented, intergranular laths of ferrite with an aspect ratio of 4:1. Because of the high silicon content in ADI, the formation of cementite phase, normally associated with the bainitic reaction in steel, is suppressed in this case. Consequently, the remaining austenite continues to be enriched with carbon as the reaction proceeds. As the austenite becomes enriched with carbon, growth of bainitic ferrite platelets is inhibited, and the reaction is arrested.

Since, the transformation that produces acicular ferrite and $\gamma_{HC}$ is a nucleation and growth process, and the nucleation depends on supercooling, as the austempering temperature decreases, the degree of supercooling increases; therefore, more ferrite is nucleated and the ferrite, as a consequence, becomes finer in nature. Additionally, in the presence of silicon, carbon rejected from the growing ferrite phase during transformation does not form carbides. Instead, the carbon enters into solid solution in the remaining austenite, enriching the carbon content of this austenite. After a certain austenitizing time, the carbon content of the remaining austenite is sufficiently enriched so that its Ms (martensite start) temperature is depressed below room temperature. This results in formation of stable, high carbon austenite ($\gamma_{HC}$). However, as the austempering temperature decreases, the growth rate of ferrite needles decreases as well. This causes the ferrite and $\gamma_{HC}$ in the matrix to become finer in scale, with a resulting increase in the volume fraction of ferrite.

In contrast, as the austempering temperature increases, the degree of supercooling decreases while the growth rate of ferrite increases. Consequently, the volume fraction of ferrite content decreases, the volume fraction of $\gamma_{HC}$ increases, and both the ferrite and austenite becomes coarser in nature.

Altering the microstructure will alter the resulting mechanical properties in ADI. For example, when austempering is performed at temperatures near 260•° C. (500•° F.), the resulting ADI has a large amount of fine ferrite and $\gamma_{HC}$ in the matrix. Thus, tensile strengths up to 260 Ksi (1600 MPa) with 1 percent elongation and hardness values in excess of 60 Rc are obtainable. Conversely, when austempering is performed at temperatures near 385•° C. (725•° F.), the ferrite and $\gamma_{HC}$ become more coarse and "feathery"; this results in tensile strengths of 120-170 Ksi (800 to 1200 MPa)) and elongations up to 14%.

In most conventional materials, the high-cycle fatigue strength increases as the monotonic yield strength or ultimate tensile strength increases. However, a number of researchers have reported that ADI shows the opposite behavior. These studies found that the fatigue strength of ADI is higher when its yield strength is lower. Thus, the high-cycle fatigue strength of ADI increases with increasing austempering temperature. The higher fatigue strength at higher austempering temperatures (with consequently lower yield strength) is due to the presence of a greater volume fraction of $\gamma_{HC}$ in the matrix. Austenite is a face-centered cubic phase; it has a higher toughness and work hardening rate compared to the body-centered cubic ferrite. Thus, as the amount of austenite in the matrix increases, a higher work hardening rate is present; hence, this leads to high fatigue strength in ADI.

As detailed previously, as the austempering temperature increases with both ferrite and austenite becomes coarser. This coarser $\gamma_{HC}$ is thought to affect the mechanical properties of ADI through increased plasticity in the matrix. One study on transformations in ADI reported that the austenite was found to transform at the crack tips to offset necking instability; this was similar to the results found for lowcarbon transformation induced plasticity (TRIP) and medium carbon forging steels. However, the study observed that this behavior occurred only when the carbon content of the austenite was relatively low.

Previous investigations on ADI with an Ausferritic microstructure have shown that they possess improved fracture toughness. When the fracture toughness is plotted against the austempering temperature, it is found that the fracture toughness initially increases with increasing temperature, reaches a maximum at an intermediate temperature and decreases with further increase in temperature. This is believed to be the result of competitive interplay between the effect of ferrite grain size and the effect of $\gamma_{HC}$ volume fraction. Ferrite has the maximum fracture toughness at the lowest austempering temperature; this is due to the fineness of the grain size developed at the low austempering temperatures. The fracture toughness of the $\gamma_{HC}$ is maximized at the higher austempering temperatures; this is due to the increased volume fraction of $\gamma_{HC}$ (relative to the ferrite). Thus the actual fracture toughness of the ADI is controlled by the "weakest link"; this is the $\gamma_{HC}$ created at low austempering temperatures and the ferrite created at high austempering temperatures.

The relationship between the volume fraction of $\gamma_{HC}$ and the carbon content of the $\gamma_{HC}$ is key to understanding the fracture toughness. This PI has developed an analytical model that is valid for in austempered ductile irons:

$$K_{IC}^2=\sigma_y(X\gamma C\gamma)^{1/2} \quad \text{(Eq. 3)}$$

where $K_{IC}$ is the fracture toughness, $\sigma_y$ is its yield strength, $X\gamma$ is the volume fraction of $\gamma_{HC}$, and $C\gamma$ is the carbon content of the $\gamma_{HC}$. Other researchers have confirmed the validity of this model. The relationship shown in Equation 3 shows that the fracture toughness of ADI can be maximized by: (a) Increasing its yield strength ($\sigma_y$); and/or (b) Increasing the austenitic carbon content ($X\gamma C\gamma$). The yield strength ($\sigma_y$) of ADI depends on the ferritic cell size and volume fraction of austenite. Researchers have shown that the $\sigma_y$ depends on width of the ferrite, L, and varies as $L^{-1/2}$. It has also observed a similar relation between the yield strength of ADI and ferritic cell size. Thus, by producing very fine-scale ferrite and austenite in the matrix, the yield strength of ADI can be optimized. Fine scale ferrite and austenite will also increase the impact strength of ADI.

Increasing the carbon content of austenite will increase the toughness of ADI, as it will result in greater interactions between dislocations and carbon atoms. The carbon content of the transformed austenite ($\gamma_{HC}$) depends on the carbon content of the initial austenite ($\gamma$) as well as austempering time and temperature. During the austempering process, as the ferrite needles grow, the austenite becomes enriched with carbon; this enrichment in carbon content will depend on the austempering time as well as temperature. Thus, if a carbon partitioning mechanism can be developed so that carbon content of austenite will be increased rapidly, then this mechanism will help in reducing the austempering processing time and at the same time will increase the fracture toughness, fatigue strength and yield strength of ADI.

In recent years, significant research has been conducted on the processing of nano-structured materials. Numerous approaches have been investigated, such as alloying, controlled rolling combined with accelerated cooling, plastic deformation and recrystallization (PDR), and repetitive corrugation and straightening (RCS). These techniques have been used to reduce the grain size down to the nanometer scale. However, all these methods have severe problems; many of them produce microporosity and contamination, which results in extremely brittle materials. The published literature indicates nearly all nano-crystal metals have tensile elongation-to-failure values much lower than their conventional counterparts; this is true even for those FCC materials that are very ductile in coarse-grained form.

Further, the literature details this nanostructure material development has focused on steel and nonferrous alloys. Virtually no investigations have been conducted to produce ADI with a nano-scale microstructure.

Accordingly, there is a need for improved methods of making nanostructured ADI having better properties.

SUMMARY

The present invention solves one or more problems of the prior art by providing in at least one embodiment a method for forming an austempered iron composition with a nanoscale microstructure. The method includes a step of heating an iron-carbon-silicon alloy with silicon to a first temperature that is lower than A1 for the iron-carbon-silicon alloy. Typically, the iron-carbon-silicon alloy including greater than about 1.7 weight percent silicon. The iron-carbon-silicon alloy is then adiabatically deformed such that the temperature of the iron-carbon-silicon alloy rises to a second temperature which is sufficient to form proeutectoid ferrite and austenite. Typically, the second temperature is above α tranus for the iron-silicon carbon alloy. The iron-carbon-silicon alloy is cooled to a first austempering temperature. The iron-carbon-silicon alloy is then heated to a second austempering temperature that is greater than the first austempering temperature to form a dual phase microstructure. Characteristically, the dual phase microstructure includes proeutectoid ferrite and ausferrite. The ausferrite includes bainitic ferrite and high-carbon austenite. Characteristically, the bainitic ferrite and the high carbon austenite each independently have at least one spatial dimension less than about 150 nm. Finally, the iron-carbon-silicon alloy is cooled to room temperature. Advantageously, the present invention requires much shorter austempering time than conventional methods for forming ADI. Accordingly, the present method is more energy efficient and more practical.

In another embodiment, a method for forming an austempered iron composition having high strength, high fracture toughness, and good ductility is provided. The method includes a step of heating an iron-carbon-silicon alloy to a first temperature that is higher than α tranus for the iron-carbon-silicon alloy. The iron-carbon-silicon alloy is cooled to a first austempering temperature. The ion-containing composition is heated to a second austempering temperature that is greater than the first austempering temperature. Finally, the iron-carbon-silicon alloy is cooled to room temperature.

In at least one aspect, the present invention bridges the gap between nano-technology and bulk materials. By applying a novel two-stage thermo-mechanical process, a unique nano-structured material can be created from a conventional material (e.g. ADI). As a result, the nADI-DMS material develops an exceptional combination of mechanical and physical properties, including high yield strength, high fatigue strength, and high fracture toughness. In conventional materials, it is well known that an increase in yield strength generally produces a decrease in the plain strain fracture toughness. On the other hand, for very high fatigue strength, a material must have very high yield and tensile strength. Accordingly, a combination of very high yield strength, fatigue strength and fracture toughness cannot be generally obtained in structural materials. The present embodiment provides a solution to this problem.

In at least on aspect, the present invention provides a method in which a ductile cast iron is converted into an austempered ductile iron with a nano-crystalline microstructure and dual matrix structure. As a result of this processing methodology, a material with an exceptional combination of mechanical and physical properties is created. This material has properties comparable to Maraging Steel without expensive alloying additions and costly processing.

DRAWING DESCRIPTION

Figure 2:
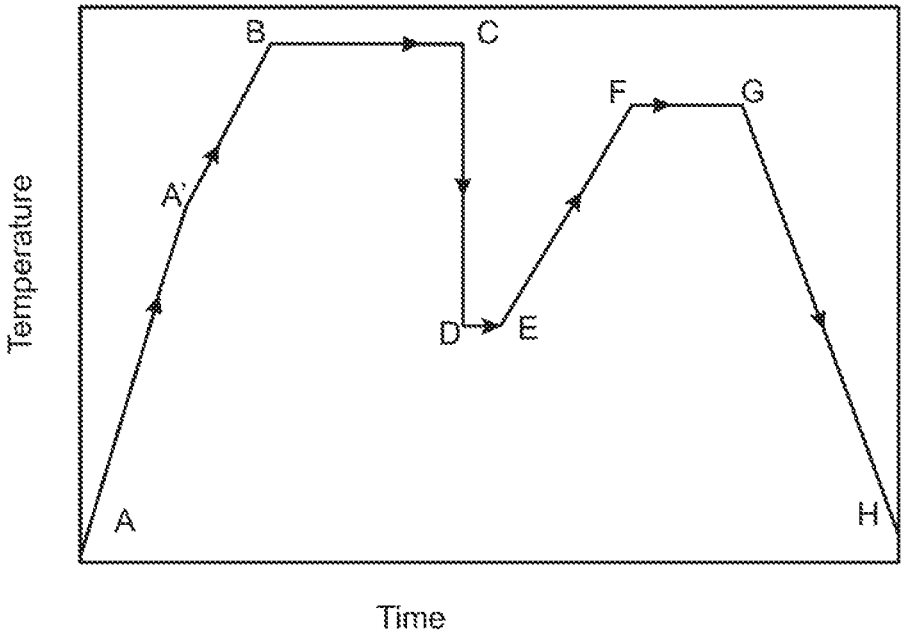
Figure 3A:
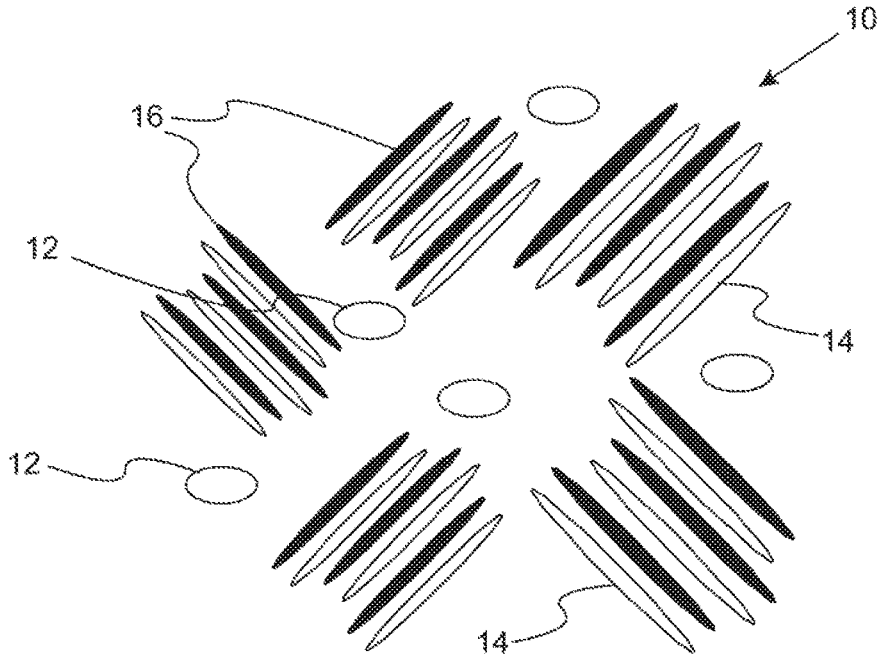
Figure 3B:
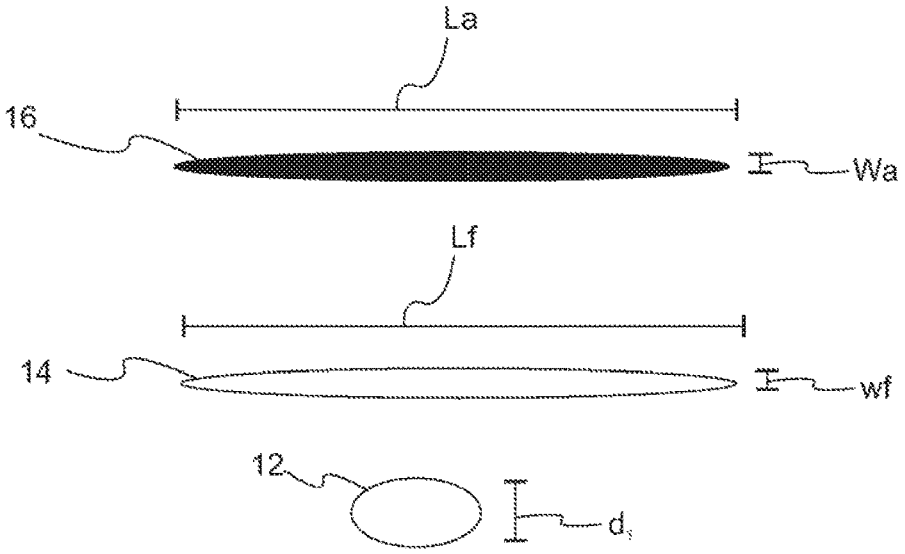
Figure 4:
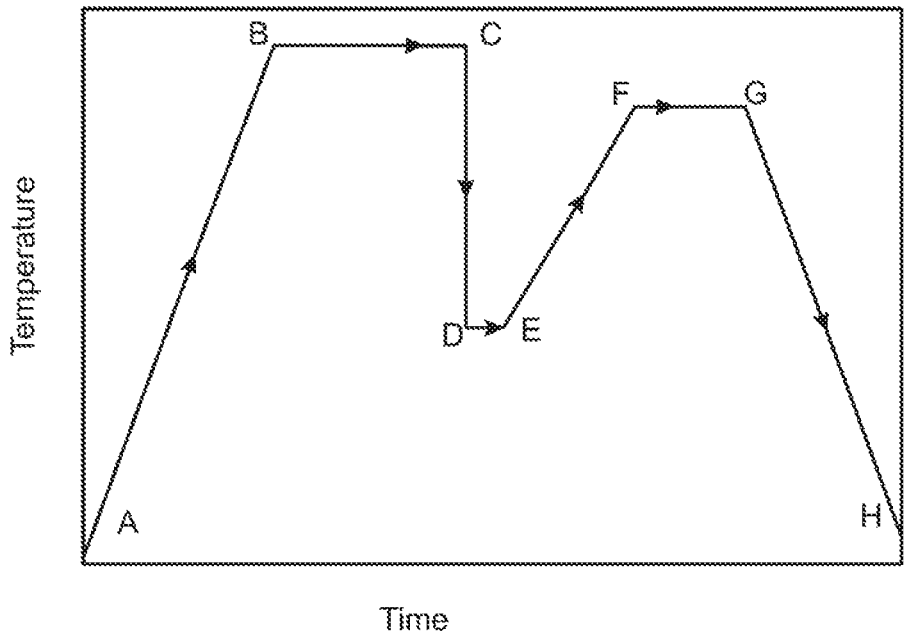
Figure 5:
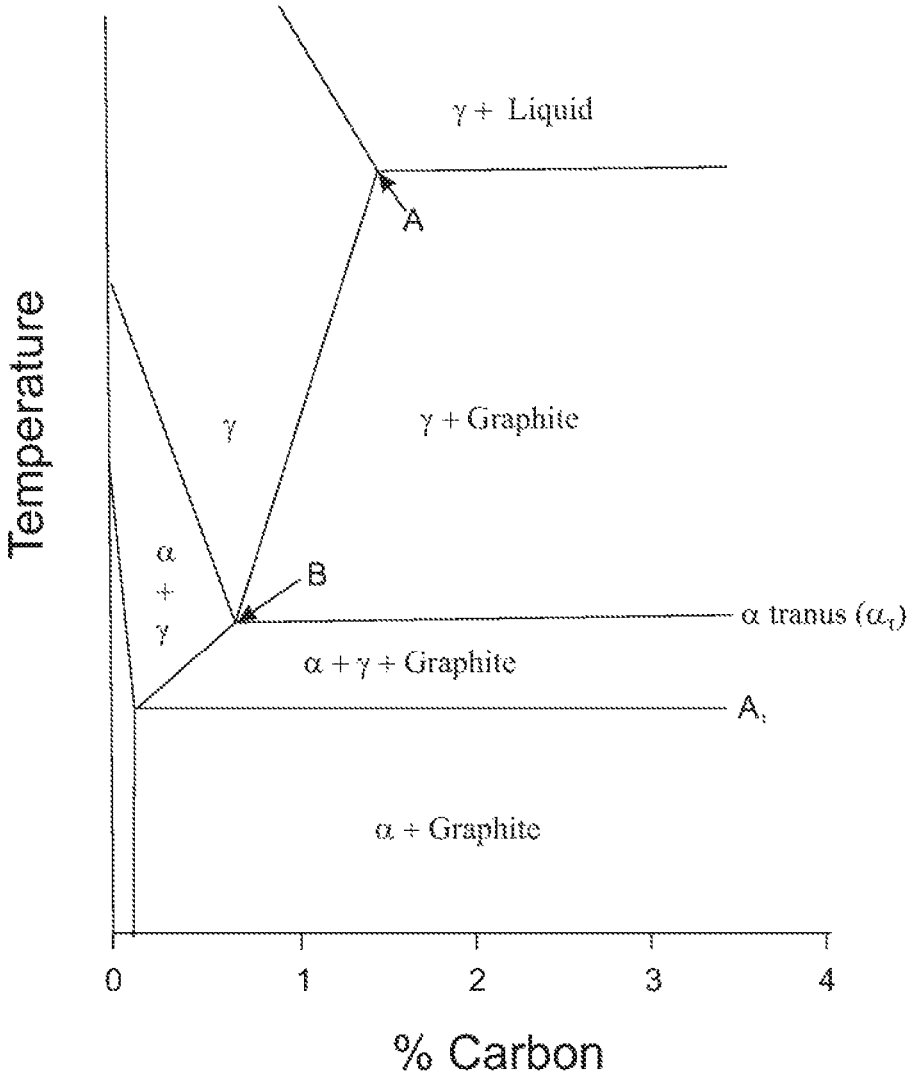
Figure 6:
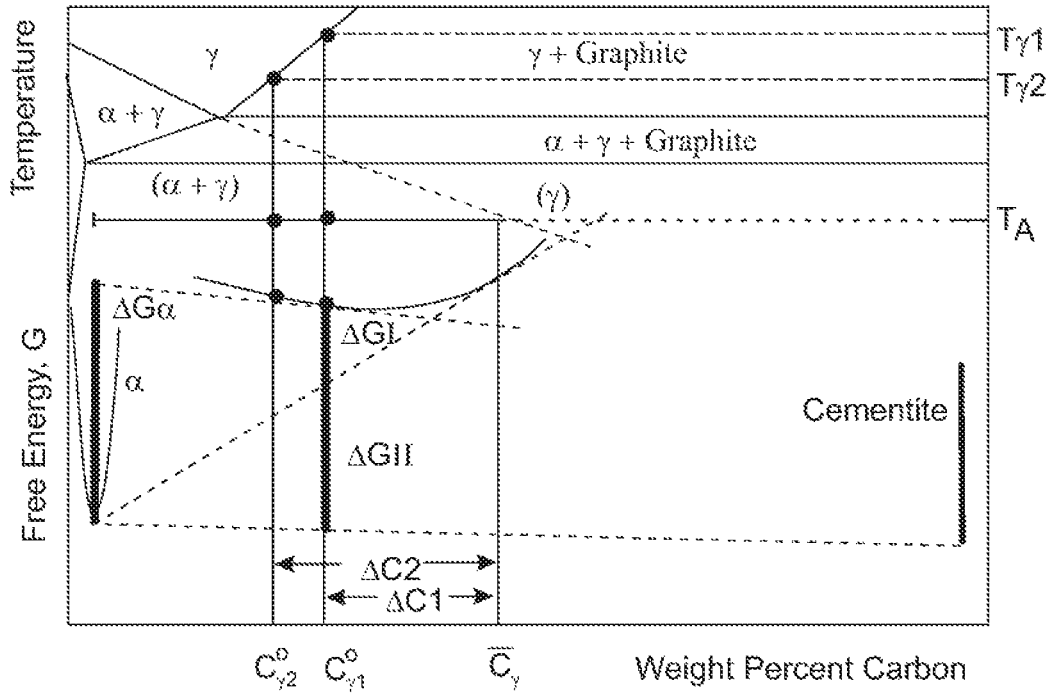

FIG. 1 provides a schematic of conventional (Single-Step) austempering process A-B-Heat up to the austenitizing temperature, B-C-Hold at the austenitizing temperature (usually 2 hrs), C-D-quench to austempering temperature, D-E-Hold at the austempering temperature (usually between 2-4 hrs), EF-Air cool to room temperature;

FIG. 2 provides a schematic of the a two-step austempering process using adiabatic deformation;

FIGS. 3A and 3B provide a schematic illustration of a dual phase microstructure; and FIG. 4 provides a schematic of the a two-step austempering process not using adiabatic deformation;

FIG. 5 provides a phase diagram for Fe-2.5% Si—C;

FIG. 6 provides a free energy diagram of Fe with 2.5% Si and C and

Figure 7:
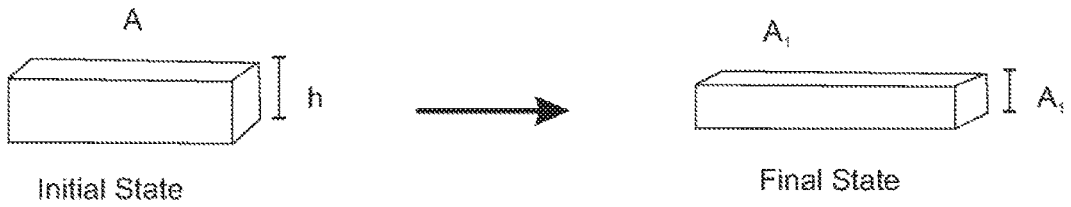

FIG. 7 is a schematic illustrating adiabatic deformation of a ductile material.

DETAILED DESCRIPTION

Reference will now be made in detail to presently preferred compositions, embodiments and methods of the present invention which constitute the best modes of practicing the invention presently known to the inventors. The Figures are not necessarily to scale. However, it is to be understood that the disclosed embodiments are merely exemplary of the invention that may be embodied in various and alternative forms. Therefore, specific details disclosed herein are not to be interpreted as limiting, but merely as a representative basis for any aspect of the invention and/or as a representative basis for teaching one skilled in the art to variously employ the present invention.

Except in the examples, or where otherwise expressly indicated, all numerical quantities in this description indicating amounts of material or conditions of reaction and/or use are to be understood as modified by the word "about" in describing the broadest scope of the invention. Practice within the numerical limits stated is generally preferred. Also, unless expressly stated to the contrary: percent, "parts of," and ratio values are by weight; the description of a group or class of materials as suitable or preferred for a given purpose in connection with the invention implies that mixtures of any two or more of the members of the group or class are equally suitable or preferred; description of constituents in chemical terms refers to the constituents at the time of addition to any combination specified in the description, and does not necessarily preclude chemical interactions among the constituents of a mixture once mixed; the first definition of an acronym or other abbreviation applies to all subsequent uses herein of the same abbreviation and applies mutatis mutandis to normal grammatical variations of the initially defined abbreviation; and, unless expressly stated to the contrary, measurement of a property is determined by the same technique as previously or later referenced for the same property.

It is also to be understood that this invention is not limited to the specific embodiments and methods described below, as specific components and/or conditions may, of course, vary. Furthermore, the terminology used herein is used only for the purpose of describing particular embodiments of the present invention and is not intended to be limiting in any way.

It must also be noted that, as used in the specification and the appended claims, the singular form "a," "an," and "the" comprise plural referents unless the context clearly indicates otherwise. For example, reference to a component in the singular is intended to comprise a plurality of components.

Throughout this application, where publications are referenced, the disclosures of these publications in their entireties are hereby incorporated by reference into this application to more fully describe the state of the art to which this invention pertains.

With reference to FIG. 2, a method for forming an austempered iron composition having a nano-scale microstructure, and in particular, austempered ductile iron having a nano-scale microstructure is provided. As indicated by the line joining A and A' (A-A'), an iron-carbon-silicon alloy is heated to a first temperature that is lower than A1 for the iron-containing temperature. A1 is the lower critical temperature for the iron-carbon-silicon alloy. As used herein, "iron-carbon alloy" means an alloy including iron, carbon, and silicon. Typically, the silicon is present in an amount greater than or equal to 1.7 weight percent (e.g., from about 1.7 to 2.8 weight percent). In a refinement, the iron-carbon-silicon alloy is a cast iron, and in particular, a ductile cast iron. In a refinement, the first temperature is within 200 degrees F. of the A1. In another refinement, the first temperature is within 100 degrees F. of A1. For some iron-carbon-silicon alloys, the first temperature is from about 1300 to 1400 degrees F. Typically, it takes from about 2 minutes to 20 minutes to heat the sample to the first temperature. In a refinement, it takes from about 5 minutes to 10 minutes to heat the sample to the first temperature. As indicated by A'-B, the iron-carbon-silicon alloy is then adiabatically deformed such that the temperature of the iron-carbon-silicon rises to a second temperature that is sufficient to form proeutectoid ferrite and austenite. In a refinement, the second temperature is above $\alpha$ tranus for the iron-carbon-silicon alloy. The term "$\alpha$ tranus" refers to the temperature at which the alloy is transformed to austenite. Typically, the second temperature is greater than 1400 degrees F. In a refinement, the second temperature is from 1500 to 1700 degrees F. In a refinement, the iron-carbon-silicon alloy is adiabatically deformed such that the iron-carbon-silicon alloy has a plastic strain from about 5 percent to about 15 percent. In a refinement, the iron-carbon-silicon alloy is adiabatically deformed for at time period less than or equal to 5 seconds. It should be appreciated that any number of methods may be used for the adiabatic deformation. Examples of such methods include, but are not limited to, hot rolling, forging or extrusion. As indicated by B-C, the iron-carbon-silicon alloy is held at the second temperature for a first hold time period which is typically from 15 minutes to 2 hours. In a refinement, the iron-carbon-silicon alloy is held at the second temperature for a first hold time period which is from 15 minutes to 1 hour. In another refinement, the iron-carbon-silicon alloy is held at the second temperature for a first hold time period which is from 15 minutes to 30 minutes.

Still referring to FIG. 2, a two stage austempering protocol is then applied to the iron-carbon-silicon alloy. As indicated by C-D, the iron-carbon-silicon alloy is then cooled to a first austempering temperature. In a refinement, the first austempering temperature is from about 450 to 550 degrees F. The iron-carbon-silicon alloy is then held at the first autempering temperature for a second hold time period with is typically from 2 to 10 minutes as indicated by D-E. Preferably, the iron-carbon-silicon alloy is then held at the first autempering temperature for a second hold time period of about minutes. In a refinement, the second hold time is sufficiently long for ferrite nucleation to be completed. As indicated by the E-F, the iron containing sample is heated to a second austempering temperature. In a refinement, the heating to the second temperature takes from 1 minute to 7 minutes. In a refinement, the heating to the second temperature takes from 2 minutes to 5 minutes. In a refinement, the second austempering temperature is from about 700 to 750 degrees F. The iron-carbon-silicon alloy is held at a third hold time period as indicated by F-G. In a refinement, the third hold time period is from about 15 minutes to 2 hours to form a iron-carbon-silicon alloy with a dual phase microstructure. Characteristically, the dual phase microstructure that includes proeutectoid ferrite and ausferrite. The ausferrite includes bainitic ferrite and high-carbon austenite. In a refinement, the high-carbon austenite include from about 1.5 to 2.2 weight percent carbon. In a refinement, the high-carbon austenite include from about 1.8 to 2.1 weight percent carbon. In still another refinement, the high-carbon austenite include from about 2.0 to 2.1 weight percent carbon Characteristically, bainitic ferrite and the high carbon austenite each independently have at least one spatial dimension less than about 150 nm. Finally, as indicated by G-H, the iron-carbon-silicon alloy is cooled to room temperature (i.e., about 68 degrees F.) to obtain the final product iron-carbon silicon alloy with the microstructure set forth above. Typically, this cooling takes from 15 minutes to 30 minutes.

With reference to FIGS. 3A and 3B, schematic illustrations of the dual phase microstructure formed by the present embodiment is provided. Microstructure 10 is observed to include proeutectoid ferrite 12 and ausferrite. The ausferrite includes bainitic ferrite 14 and high-carbon austenite 16. Bainitic ferrite 14 and high-carbon austenite 16 are observed to have a needle-like structure (e.g., acicular). The width Wf of the bainitic ferrite 14 is typically less than about 200 nm while the length Lf is typically from 0.5 microns to 2 microns or greater. Similarly, the width Wa of the high-carbon austenite 16 is typically less than about 200 nm while the length La is typically from 0.5 microns to 2 microns or greater. In a refinement, Wf and Wa are each independently, in order of preference, less than or equal to, 200 nm, 150 nm, 120 nm, 100 nm. In another refinement, Wf and Wa are each independently, in order of preference, greater than or equal to, 30 nm, 50 nm, 60 nm, 70 nm. The morphology of the proeutectoid ferrite 12 is typically ovoid. In a refinement, the proeutectoid ferrite 12 has at least one spatial dimension $d_1$ less than about 200 nm. In other refinements, the proeutectoid ferrite 12 has at least one spatial dimension less than about or equal to, 200 nm, 150 nm, 120 nm, 100 nm. In a refinement, the final product iron-carbon silicon alloy includes about 5 to 10 weight percent proeutectoid ferrite, about 80 to 85 weight percent ausferrite, and about 5 to 15 percent graphite (and/or iron carbides).

As set forth above, the embodiments of the invention utilize and iron-carbon-silicon alloy. In a refinement, the iron-carbon-silicon alloy includes from 3.0 to 3.8 weight percent carbon, 2.2 to 2.6 weight percent silicon, and the balance iron. In a refinement, the iron-carbon-silicon alloy includes from 3.3 to 3.8 weight percent carbon, 2.2 to 2.6 weight percent silicon, and the balance iron. In a refinement, the iron-carbon-silicon alloy further includes 0.2 to 0.5 weight percent manganese, 0.2 to 0.7 weight percent copper, 0.8 to 1.2 weight percent nickel, and 0.1 to 0.35 weight percent molybdenum.

The present embodiment advantageously increases the strength, toughness and ductility of ausferritic microstructures produced by austempering in the upper bainitic transformation region (316-385° C.). The enhancement of these properties is obtained by increasing the amount of proeutectoid ferrite present in the matrix of the ausferrite by intercritical austenitizing. The spacing between the ferrite-austenite lathes is reduced by a two-step austempering process. The third technique that can increase the strength and toughness is the reduction in the prior austenite grain size through adiabatic deformation. In a refinement, adiabatic deformation is accomplished by hot-working in the intercritical region under adiabatic conditions. Hot-working creates recrystallization with an attendant refinement of the austenite grain size. Subsequent quenching in hot salt (austempering) will produce a refined structure. The benefit of finer prior austenitic grain size has been clearly established.

Nanostructured ADI can also be a substitute structural material by itself in many critical applications (where a combination of very high strength and fracture toughness is required) instead of wrought or forged steels because it will have several advantages. Ductile Cast Iron has lower density than steel. Therefore it will have significantly higher specific strength than commercial alloy steels. Cast Irons are less expensive than steel. Therefore the structural components will be more economical when made of nanostructured ADI.

As set forth above, the prior art indicates that nearly all nano crystal metals have low ductility compared to their conventional micro-crystalline counterparts. The strength of nano-structured ADI will be much higher than its conventional counterparts but reduction in its ductility seem to be inevitable. In a refinement of the present invention, reduction in ductility in nanostructured ADI is compensated by the production of nano-structured ADI with DMS which contains proeutectoid ferrite with its amount can be controlled by austempering from intercritical austenitizing temperature ranges.

As set forth above, intercritical austempering of ductile cast iron produces a dual matrix, consisting of proeutectoid ferrite, and ausferrite (bainitic ferrite and high-carbon austenite). This material will exhibit much greater ductility than the conventionally austempered or the quenched and the tempered ductile iron. The tensile, the yield strength and the ductility of this material is greater than the pearlitic grades. Therefore, this material will have significant applications in automotive components, e.g. suspension parts which require a good combination of high strength and ductility.

With reference to FIG. 4, a method for forming an austempered iron composition with improved strength and fracture toughness is provided. As indicated by the line joining A and B (A-B), an iron-carbon-silicon alloy is heated to a first temperature that is higher α tranus for the iron-carbon-silicon alloy. The iron-carbon-silicon alloy compositions set forth above are used in this embodiment too. In a refinement, the first temperature is from 1500 to 1700 degrees F. Typically, it takes from about 2 minutes to 20 minutes to heat the sample to the first temperature. In a refinement, it takes from about 5 minutes to 10 minutes to heat the sample to the first temperature. As indicated by B-C, the iron-carbon-silicon alloy is held at the second temperature for a first hold time period which is typically from 15 minutes to 2 hours. In a refinement, the iron-carbon-silicon alloy is held at the second temperature for a first hold time period which is from 15 minutes to 1 hour. In another refinement, the iron-carbon-silicon alloy is held at the second temperature for a first hold time period which is from 15 minutes to 30 minutes.

As indicated by C-D, the iron-carbon-silicon alloy is then cooled to a first austempering temperature with the alloy subject to a two stage austempering protocol that is similar to the protocol set forth above in connection with the description of FIG. 2. In a refinement, the first austempering temperature is from about 450 to 550 degrees F. The iron-carbon-silicon alloy is then held at the first autempering temperature for a second hold time period with is typically from 2 to 10 minutes as indicated by D-E. In a refinement, the second hold time is sufficiently long for ferrite nucleation to be completed. As indicated by the E-F, the iron containing sample is heated to a second austempering temperature. In a refinement, the second austempering temperature is from about 700 to 750 degrees F. In a refinement, it takes from about 1 minutes to 7 minutes to heat the sample to the second austempering temperature. In a refinement, it takes from about 2 minutes to 5 minutes to heat the sample to the first temperature. The iron-carbon-silicon alloy is held at a third hold time period as indicated by F-G. In a refinement, the third hold time period is from about 15 minutes to 2 hours. Finally, the alloy is cooled to room temperature as indicated by G-H. Typically, this cooling takes about 15 to 30 minutes.

The phase diagram of Fe-2.5% Si—C diagram is shown in FIG. 5. It is evident from this figure that ADI with DMS can be produced by austempering from intercritical annealing temperature range (ICAT). Control over the ICAT can play an important role in determining the austenite volume fraction (AVF) and its carbon content. If we draw a vertical line at 3.5% C in this phase diagram to the intercritical temperature range, i.e. between $A_1$ and α tranus and a tie line to the temperature axis, it becomes obvious that AVF and its carbon content decreases with decreasing austenitizing temperature as predicted by the lever rule. This important feature makes it possible to control the proeutectoid ferrite and AVFs during austenitizing in the two phase region and will determine the austenite carbon content before austempering from ICAT which in turn should result in austenite stabilization during austempering.

Austempered ductile iron with DMS exhibits much greater ductility than conventional ADI. The strength and ductility of this material is much higher than that of ferritic grades and its strength is at almost the same level as that of pearlitic grades while ductility is almost more than four times higher than that of pearlitic grades. The other advantages of this material are as follows: (a) Proeutectoid ferrite and ausferrite volume fractions can be controlled precisely to determine the strength and ductility of ADI with DMS. (b) For a wide combination of intercritical austenitizing and austempering times, the tensile strength and ductility can be satisfactorily optimized. (c) The strength and ductility of ADI with DMS is much higher than that of ferritic grades and its strength is at almost the same level as that of pearlitic grades while ductility is almost more than four times higher than that of pearlitic grades. (d) This material also meets the requirements for the strength of quenched and tempered grades and its ductility is superior to that of this grade. (e) Comparing to austenitization temperature differences between ADI with DMS and conventional ADI, production of ADI with DMS is an energy saving process which requires lower austenitization temperature.

FIG. 6 shows the free energy diagram of Fe with 2.5% Si and C, including part of the metastable ferrite and austenite phase boundary, which is represented with the coarse-dashed line. TA represents the austempering temperature. This phase diagram also includes free energy curves for ferrite (α), austenite (γ) and cementite at the austempering temperature, which show the driving force for the nucleation of ferrite (Gα), total driving force for stage I ($G_I$) and total driving force for the stage II reaction ($G_{II}$). These values are obtained in the following manner:

The value for $G_\alpha$ is the difference between the fine-dashed tangent line to the austenite free energy at the average composition, and the ferrite free energy curve at its minimum. Consequently, if the slope of the tangent line is changed or the entire austenite free energy curve is moved up or down, the nucleation rate of ferrite will be affected.

The value for $G_I$ is obtained from the difference between the austenite free energy curve and the fine dashed line that is tangential to both the ferrite free energy curve and the austenite free energy curve at the average composition. Therefore, if the average composition of the material is changed to reduce the amount of carbon, the driving force behind the stage I reaction would increase.

The value for $G_{II}$ is the difference between the fine-dashed line tangential to both the ferrite and austenite free energy curves and the fine-dashed line tangential to both the ferrite and cementite free energy curves. Then, for example if the average composition for the material is changed to reduce the amount of carbon, the driving force for the stage II reaction will decrease.

It is evident that to increase the nucleation rate of ferrite, it is beneficial to increase $G_\alpha$ and $G_I$, while decreasing $G_{II}$. Ideally, the material should have fine grains and no carbide formation. The two-step austempering process of the present invention meets these criteria. First it is theorized that the initial quench in the two-step process will increase $G_\alpha$, which will increase the number of grains in the material, and therefore reduce their size. Second, thermodynamically, a higher austempering temperature will increase $G_{II}$, while decreasing $G_I$. Now if the final austempering temperature is kept above the potential epsilon carbide phase boundaries, it will avoid carbide formation is nearly completely avoided. This observation provides the thermodynamic basis for the present invention's two step austempering process.

As set forth above, the austempering reaction in iron-carbon alloys involves nucleation of ferrite from austenite and subsequent growth. Therefore if an iron carbon alloy is austenitized at higher temperature (say 871° C. (1600° F.) and then quenched to a lower temperature (say 260° C. (500° F.)) there will be greater super cooling and thus more ferrite will be nucleated. Now immediately after that (once the ferrite nucleation is complete) if we heat up this iron carbon alloys to a higher austempering temperature, or in other words do a second stage austempering at a higher temperature (say 371° C. (700° F.)), then the ferrite will grow at a much faster rate. Thus carbon content of austenite will increase rapidly i.e. the remaining austenite will become enriched with carbon very quickly or in other words the end point of first reaction (equation 1) will be reached very rapidly. As for example if we austenitize ADI say at 871° C. (1600° F.) and then austemper it at 260° C. (500° F.) by single step we will have fine ferrite and austenite but to reach a carbon content of say 2.1 percent in austenite (maximum solubility of carbon in austenite is 2.1%), it may take up to three or four hours. On the other hand, if we austenitize the alloy at 871° C. (1600° F.) and then initially quench at 260° C. (500° F.) for a short period (till nucleation is complete), and then quickly raise the temperature higher (say to 371° C. (700° F.)), austenite will reach the same level of carbon content of 2.1% in a much shorter time than if it had been austempered only at 260° C. (500° F.) by a single-step process. Moreover it will produce very fine grain ausferrite structure in ADI. Thus it becomes evident that larger super cooling of austenite and two-step austempering is the ideal processing route for iron-carbon alloys, and will result in a very large volume fraction of the fine carbide free ferrite, together with finer austenite with very high carbon content. This in turn should result in a remarkable combination of mechanical properties (simultaneous high yield strength, fatigue strength and fracture toughness). In addition it will reduce the time for transformation reaction (equation 1) significantly or in other words it will be an overall energy saving process.

In the embodiments set forth above, the application of adiabatic deformation is understood as follows. A material enclosed in an adiabatic chamber so that no heat is allowed in or move out. It is known from First law of thermodynamics that:

$$\partial Q+\partial W=\partial H+\partial PE+\partial KE \tag{4}$$

Since the material under consideration is non-moving and stationary, both ∂KE and ∂PE≈0. Moreover, since under Adiabatic process no heat allowed in the system, ∂Q=0. Therefore $$\partial W=\partial H \tag{5}$$

It is known that ∂H=CpdT, where Cp is the heat capacity and dT is change in temperature. On integration of equation (5), from an initial temperature $T_1$ to a final temperature $T_2$ $$\int_0^{\Delta W} \partial W = \int_{T_1}^{T_2} C_p \cdot dT \tag{6}$$

$$\Delta W = \int_{T_1}^{T_2} C_p dT = C_p(T_1 - T_2) = C_p \Delta T \tag{7}$$

where $\Delta T = T_2 - T_1$

Assuming Cp=constant at a constant temperature. The heat capacity Cp is function of temperature but for a solid metal under consideration and if the change in temperature ΔT is not very large a reasonable approximation will be that Cp is constant. Therefore, $$\Delta W=Cp\bullet\Delta T \tag{8}$$

or $$\Delta T=\Delta W/Cp \tag{9}$$

where $T_2$ is final temperature in Kelvin and $T_1$ is the initial temperature in Kelvin and $\Delta T=T_2-T_1$ is the increase in the temperature due to adiabatic deformation. (Since K=° C.+273, ΔT values will be same in ° C.)

A material being deformed under adiabatic condition from an initial state to a final state is now considered. With reference to FIG. 7, let in the initial condition the metal has a height h and cross sectional area A and in the final deformed state the height is $h_1$ and area $A_1$. Then $A_1$, the final cross sectional area can be obtained from volume constancy.

$$A_0 = \frac{A_0 h_0}{h_1} \tag{10}$$

The work of deformation ΔW is the product of the volume of the specimen (V) and the specific energy (u)

$$\Delta W=V\bullet u \tag{11}$$

But u is given by:

$$u = \int_0^{\varepsilon} \sigma \cdot d\varepsilon \tag{12}$$

where $\sigma$ = true stress and $\varepsilon$ = true strain

If the material is strain hardened, with a true stress—true strain curve given by Holloman's equation $$\sigma = K\varepsilon^n \tag{13}$$

Then the expression for force at any stage during deformation becomes $$F = Y_f A_1 \tag{14}$$

where $Y_f$ is the flow stress of the material, corresponding to the true strain ($\varepsilon_1$) and $\varepsilon_1$ is given by.

$$\varepsilon_1 = \ln\frac{h_0}{h_1}$$

Considering friction, the expression for the work done ΔW is $$\Delta W = (\text{Volume})(\overline{Y})(\varepsilon_1) \tag{15}$$

Where $\overline{Y}$ is the average flow stress and is given by $$\Delta W = \frac{V \cdot K\varepsilon_1^n}{n+1} \cdot \varepsilon_1 \tag{17}$$

Now from equation (9) we get;

$$\Delta T = \frac{V \cdot K\varepsilon_1^{n+1}}{(n+1)} \cdot \frac{1}{C_p} \tag{18}$$

If the value of the strain hardening exponent (n), strength co-efficient (K) and heat capacity Cp are known, the increase in temperature ΔT as a result of a certain amount of plastic deformation or plastic strain (ε1) can be estimated. For example, for a reduction in height of 10% and assuming a value of K=800 MPa and n=0.10, Cp=515 J/kg° K in the fully austenitic range for ADI i.e. at a temperature of 788° C. (1450° F.), we can see that in a 10 cm×10 cm×10 cm (4"×4"×4") material, the increase in temperature i.e. ΔT will be about 112° C. (200° F.). It is recognized that this is an ideal situation. It is not possible to achieve totally adiabatic condition. Invariably some heat will be lost due to conduction, convection and radiation and we may have to deform the material more than 10% to achieve similar increase in temperature. However ADI has reasonable ductility at room temperature. Moreover at elevated temperature the ductility will be still higher (more than 10%). Therefore at the anticipated deformation temperature, ADI will have more than enough ductility to carry out the required amount of plastic deformation under adiabatic condition.

The above equation also indicates that if the material is plastically deformed under adiabatic condition, there will be a rise in temperature in the system i.e. ΔT will be positive. Therefore by adiabatically deforming the material we can increase the temperature of the body. Embodiments of the invention take advantage of this phenomenon while doing the two-step austempering process. For example, for the austempering process the iron-carbon-silicon alloy is first austenitized. The material is heated to about 1350° F. for austenitizing and then quenching to initial austempering temperature. The material is heated to a lower austenitizing temperature of say 1200° F. and then adiabatically deformed so that its final temperature will increase to over 1400° F. The iron-carbon-silicon alloy is then quenched to the first austempering temperature and then a second austempering temperature as set forth above. In this way the material will not have to be heated up to full 1350° F. with the heat generated by the adiabatic deformation advantageously utilized.

Another advantage of adiabatic deformation is that it leads to a finer austenitic grain size. Transformation to an ausferrite structure in the upper bainite region is initiated by the nucleation of the bainitic-ferrite phase at the austenite grain boundaries. Therefore, a fine ustenite grain size will produce a fine-grained austempered microstructure with improved mechanical properties. Any action that causes refinement of the austenite grain size will produce the desired effect. In terms of parent austenite grain refinement, a fully martensitic starting structure is used. Since the martensitic microstructure has a number of precipitation sites such as plate interfaces, plate colony boundaries and prior austenite grain boundaries for the austenite to form, and thus, comparing to pearlitic starting microstructure, a more finely dispersed austenite will be obtained. Fine grained austenite will have high grain boundary which will enhance nucleation and accelerate ausferrite transformation.

Therefore, in a refinement, a method includes steps of heating a ductile cast iron with fully martensitic matrix structure to somewhat below the A1 temperature (nominally 1350° F.). After temperature stabilization, the material is deformed adiabatically (nominally between 5% and 10%). The deformation energy imparted to the material raises the temperature of the material with proeutectoid ferrite to the intercritical austempering temperature range i.e. above the A1 temperature (between A1 and α transus) and cause transformation to a fine-grained austenite. Subsequently, the material is quenched to the initial austempering temperature and processed by two step austempering process.

By applying the two-step process to a fine grained material, a nano crystalline microstructure and very high carbon in the austenite is formed. Further higher density of nucleation at the same growth rate causes the austempering reaction (stage 1) to occur very fast i.e. the end point of reaction one will be achieved quickly. The purpose of two step austempering is to momentarily force the material into the lower bainitic region to increase nucleation and then to raise the temperature of transformation into the upper bainitic region to grow the ausferritic structure. A heating rate of about 10° F./sec is used. Finally, in a refinement, a significant amount of lower bainite is not formed in the material.

Selection of the Alloy Composition:

The primary purpose of adding alloying elements such as copper, nickel or molybdenum to ADI is to increase the hardenability of the matrix sufficiently to ensure that the formation of pearlite is avoided during the austempering process. Only the minimum amount of alloys required to through harden the part is employed. Excessive alloying only increases the cost and difficulty of producing the good quality Ductile Iron necessary for ADI. In the case of Mo addition, carbide formation seems to be inevitable. For the best combination of strength and ductility carbide free ferrite and austenite is required in ADI structure. Molybdenum is the most potent hardenability agent in ADI, and may be required in heavy section castings to prevent the formation of pearlite. However, both tensile strength and ductility decrease as the molybdenum content is increased beyond that required for hardenability. This deterioration in properties is caused by the segregation of molybdenum to cell boundaries and the formation of carbides. The level of molybdenum is therefore restricted to not more than 0.2% in heavy section castings. To avoid micro-segregation and the resultant degradation of mechanical properties associated with higher levels of manganese and molybdenum, their levels need to be carefully controlled with the desired hardenability obtained by supplementary additions of first copper (up to about 0.8%), then nickel. Up to 0.8% copper may be added to ADI to increase hardenability. Copper has no significant effect on tensile properties but increases ductility. Up to 2% nickel can be used to increase the hardenability of ADI. For austempering temperatures below 675° F. (350° C.) nickel reduces tensile strength slightly but increases ductility and fracture toughness. Therefore, the following composition of ADI is found useful for the methods set forth above: Carbon—3.7%+/−0.2%, Silicon—2.5%+/−0.2%, Manganese—0.28%+/−0.03%, Copper—as required+/−0.05% up to 0.8% maximum, Nickel—as required+/−0.10% up to 2.0% maximum, Molybdenum—only if required+/−0.03% up to 0.25% maximum. (Carbon and silicon are controlled to produce the desired carbon equivalent for the section size being produced).

While exemplary embodiments are described above, it is not intended that these embodiments describe all possible forms of the invention. Rather, the words used in the specification are words of description rather than limitation, and it is understood that various changes may be made without departing from the spirit and scope of the invention. Additionally, the features of various implementing embodiments may be combined to form further embodiments of the invention.

What is claimed is:

1. A method for forming an austempered iron composition with a nanoscale microstructure, the method comprising:

a) heating an iron-carbon-silicon alloy with silicon to a first temperature that is lower than A1 for the iron-carbon-silicon alloy, the iron-carbon-silicon alloy including greater than about 1.7 weight percent silicon;

b) adiabatically deforming the iron-carbon-silicon alloy such that the temperature of the iron-carbon-silicon alloy rises to a second temperature, the second temperature being sufficient to form proeutectoid ferrite and austenite, the second temperature being above α tranus for the iron-carbon-silicon alloy;

c) cooling the iron-carbon-silicon alloy to a first austempering temperature;

e) heating the iron-carbon-silicon alloy to a second austempering temperature that is greater than the first austempering temperature to form a dual phase microstructure, the dual phase microstructure including proeutectoid ferrite and ausferrite, the ausferrite including bainitic ferrite and high-carbon austenite, the bainitic ferrite and the high carbon austenite each independently having at least one spatial dimension less than about 150 nm; and g) cooling the iron-carbon-silicon alloy to room temperature.

2. The method of claim 1 wherein the iron-carbon-silicon alloy is a cast iron.

3. The method of claim 1 wherein the iron-carbon-silicon alloy includes from 3.3 to 3.8 weight percent carbon, 2.2 to 2.6 weight percent silicon, 0.2 to 0.5 weight percent manganese, 0.2 to 0.7 weight percent copper, and the balance iron.

4. The method of claim 3 wherein the iron-carbon-silicon alloy further includes 0.8 to 1.2 weight percent nickel, 0.1 to 0.35 weight percent molybdenum.

5. The method of claim 1 wherein the iron-carbon-silicon alloy is adiabatically deformed such that the iron-carbon-silicon alloy has a plastic strain from about 5 percent to about 15 percent.

6. The method of claim 1 wherein the iron-carbon-silicon alloy is adiabatically deformed for a time period less than about 5 seconds.

7. The method of claim 1 wherein the iron-carbon-silicon alloy is adiabatically deformed by hot rolling, forging or extrusion.

8. The method of claim 1 wherein the first temperature is within 200 degrees F. of the austenitizing temperature for the iron containing composition.

9. The method of claim 1 wherein the first temperature is from about 1300 to 1400 degrees F.

10. The method of claim 1 wherein the iron-carbon-silicon alloy is held at the second temperature for a first hold time period.

11. The method of claim 10 wherein the first hold time period is from 15 minutes to 2.0 hours.

12. The method of claim 1 wherein the first austempering temperature which is from about 450 to 550 degrees F.

13. The method of claim 1 wherein the iron-carbon-silicon alloy is held at the first austempering temperature for a second hold time period.

14. The method of claim 13 wherein the second hold time period is from about 2 to 10 minutes.

15. The method of claim 13 wherein the second hold time is sufficiently long for ferrite nucleation to be completed.

16. The method of claim 1 wherein the second austempering temperature is from about 700 to 750 degrees F.

17. The method of claim 1 wherein the iron-carbon-silicon alloy is held at the second austempering temperature for a third hold time period.

18. The method of claim 17 wherein the third hold time period is from about 15 minutes to 2 hours.

* * * * *